United States Patent [19]

Steinmiller

[11] 3,997,450

[45] Dec. 14, 1976

[54] SYNTHETIC FIBERS OF ENHANCED PROCESSABILITY

[75] Inventor: William G. Steinmiller, Charlotte, N.C.

[73] Assignee: Fiber Industries, Inc., Charlotte, N.C.

[22] Filed: Mar. 15, 1974

[21] Appl. No.: 451,631

Related U.S. Application Data

[63] Continuation-in-part of Ser. No. 242,776, April 10, 1972, abandoned.

[52] U.S. Cl. ..... 252/8.7; 252/8.8; 252/8.9

[51] Int. Cl.[2] ..... D06M 11/12

[58] Field of Search ..... 252/8.7, 8.9, 8.8; 427/353

[56] References Cited

UNITED STATES PATENTS

| | | | |
|---|---|---|---|
| 2,183,853 | 12/1939 | Hausmann et al. | 252/8.9 X |
| 2,263,007 | 11/1941 | McNally et al. | 252/8.9 X |
| 2,690,426 | 9/1954 | Jefferson et al. | 252/8.9 X |
| 3,004,056 | 10/1961 | Nunn et al. | 252/8.9 X |
| 3,170,877 | 2/1965 | Beiswanger et al. | 252/8.9 X |
| 3,306,850 | 2/1967 | Olsen | 252/8.7 |
| 3,338,830 | 8/1967 | Stokes et al. | 252/8.7 |
| 3,639,235 | 2/1972 | Karg | 252/8.9 X |
| 3,644,204 | 2/1972 | Heins | 252/8.9 X |
| 3,652,419 | 3/1972 | Karg | 252/8.9 X |

FOREIGN PATENTS OR APPLICATIONS

| | | | |
|---|---|---|---|
| 463,624 | 4/1937 | United Kingdom | 252/551 |

OTHER PUBLICATIONS

GAF Tech. Bull. 6220–7001 published 1970 by GAF Corp., NY, NY pp. 1, 2, 5.

*Primary Examiner*—J. Ziegler
*Attorney, Agent, or Firm*—Robert J. Blanke

[57] ABSTRACT

Synthetic fibers, such as filaments and yarns, of enhanced processability by virtue of a non reactive finish thereon including a fatty acid ester or mineral, animal or vegetable oil lubricant; an end capped emulsifier of a condensate of a long chain ester, alcohol, amide and/or a hydroxy-terminated, alkyl-substituted aryl; and, if desired, a small but effective amount of a salt of a dialkyl sulfosuccinic acid.

12 Claims, No Drawings

SYNTHETIC FIBERS OF ENHANCED PROCESSABILITY

This invention is a continuation-in-part application of copending application Ser. No. 242,776 filed Apr. 10, 1972, and now abandoned.

BACKGROUND

Before synthetic fiber finishes are deemed acceptable for use on filaments, yarns, and the like, they are subjected to close scrutiny. For instance, it is important to know with respect to finishes, such as lubricant compositions, their compatibility with the filamentary substrate; their ability to promote fiber bundle cohesion and enhance interfilament friction characteristics; their effect, deleterious or not, on dyeability, fiber strength or moisture level; their ability to counter flaring; their fiber/metal lubrication behavior; their manufacturing drawing processing and false twisting processing characteristics; their stability and durability, characteristics which are very helpful in avoiding handling or processing difficulties, particularly at high speeds for long periods of time and under a number of changing conditions, such as temperatures, stresses, running tensions, moisture, and the like; and their penchant, if any, for becoming viscous or tacky under these varying conditions, thus creating severe running tensions and, possibly, inordinate deposition characteristics.

Still another criterion has been imposed on finish compositions by dint of modern textile processing equipment. False twist texturing equipment, for example, has certain parts, such as cots and aprons, generally constructed of polyurethane resins which are sensitive to otherwise acceptable finish compositions. Experience has shown that these finishes, containing as they do emulsifiers of the nature of alkoxylated aliphatic or aromatic alcohols, fatty acids and partial esters of each, along with antistats of neutral salts of alcohol phosphate esters, quanternary ammonium salts, amines and amides, cause belt swelling, i.e., they attack and deteriorate polyurethane feed aprons and cots. Not only does this cause increased belt maintenance and replacement costs, but reduced yarn quality as well. Obviously, yarn could run longer with less belt maintenance, the number of snags and broken filaments could be minimized, thus enhancing yarn quality, if finish attack could be obviated.

The present invention is directed to finish compositions which are not only compatible with the yarn but which substantially enhance its processing characteristics. The enhancement is characterized as well by the insensitivity of certain texturing equipment parts to the unqiue finish compositions of the present invention.

Of interest are the following patents: U.S. Pat. No. 3,306,850 and U.S. Pat. No. 3,428,560.

INVENTION

The present invention related to finish compositions for synthetic fibers spun from polycondensation polymers, such as polyamides (the nylons), polyesters, and the like. More particularly, the instant discovery concerns finish compositions which are not only compatible with, say, filaments and yarns, but which very effectively enhance their processing characteristics and do not adversely affect either the yarn properties per se or the processing equipment. Obviously, any attack or deleterious effect on the processing equipment, such as false twist texturing equipment, by an otherwise effective finish composition can, in turn, seriously reduce the quality of the yarn through, for instance, abrasive or uneven contact which occasions broken filaments, snags, and the like.

According to the present discovery a superior finish composition has been found which comprises a synthetic yarn lubricant and an end capped emulsifier of a condensate of an alkylene(lower) oxide and a polyhydric aliphatic alcohol and/or a synthetic fatty acid ester and/or a synthetic fatty alcohol and/or a partial ester of said polyhydric alcohol and a synthetic fatty acid and/or an alkanolamine-fatty acid amide and/or an alkyl phenol, the reactive hydroxy groups of the emulsifier being end capped with a group selected from methyl, acetyl, sulfate, phosphate, the residue of a fatty acid ($C_8$–$C_{18}$), or a mixture of these.

Processes for end capping reactive hydroxy groups are well known to the art, however, a convenient system for methyl or ethyl end capping is the reaction of the hydroxy groups of the emulsifier with methyl or ethyl halide by the process commonly known as the Williamson ether synthesis. Methylation may also be achieved by reacting the hydroxy groups of the emulsifier with trimethylsulfoxonium iodide or diazomethane in the presence of $BF_3$ or $HBF_4$. Sulfate end capping, or sulfonation of the hydroxy groups of the emulsifier may be obtained by reacting the hydroxy groups with a sulfur trioxide-dioxane combination, a sulfur trioxide-pyridine combination or a sulfur trioxide-triethylamine combination as reported by N. H. Christensen, Chem. Scand., 15,1507 (1961). Phosphate end capping of the hydroxy groups of the emulsifier to obtain phosphate esters may be carried out by reacting the emulsifiers with $POCl_3$ in the presence of pyridine as reported by D. M. Brown, Advances in Organic Chemistry, Volume 3, page 87 (1963). Acetyl end capping or acetylation of hydroxy groups is reported by P. Blandon et al., Journal of the Chemical Society 4883 (1952) while end capping hydroxy groups with a fatty acid or acid anhydride to form an ester is disclosed by B. D. Scully, Analyst, 87,1940 (1962).

If desired, a small but effective amount of an alkali metal or ammonium salt of a dialkyl sulfosuccinic acid emulsifier-stabilizer, such as potassium di-(2-ethylhexyl)-sulfosuccinate, is added to provide further finish stability under the aforementioned varied processing conditions. Of course, other conventional components, such as antistats, bacteriastats, antioxidants, and the like, may be present without hindering the efficacy of the above components of the total finish composition. While the reason for the effectiveness of the novel finish composition of the present invention is not fully understood, it is theorized that conventional texturing finishes contain moieties, such as hydroxyl groups, which are highly reactive and tend to solvate and swell a number of different polyurethane or rubber component parts of processing or texturing equipment. Sources of reactive moieties are conventional emulsifiers which are, for example, polyoxyethylene condensates ending in hydroxyl groups. End capping, it is felt, shields and/or sterically hinders these reactive sites; end capping, it has been found, not only significantly reduces attack on the polyurethane feed aprons, and the like, but it substantially enhances processability, minimizes deposition, reduces filament flaring, etc., without sacrificing the remaining desirable characteristics hereinbefore enumerated as criteria.

Pursuant to the instant discovery it has been found, also, that conventional antistats, such as neutral salts of alkoxylated esters of aliphatic $C_6$–$C_{18}$ alcohols and phosphoric acid, such as alkali, and ammonium salts of alkoxylated (lower alkyl) aliphatic ($C_6$–$C_{18}$) alcohol phosphate esters, are likewise, when present, effective. Further, it has been found, pursuant to the present invention, that the aforementioned emulsifiers, when end capped as herein contemplated, function as antistatic agents in a neutral salt, e.g., alkali metal and ammonium salts, form and, consequently and quite surprisingly, may be used in lieu of or in conjunction with the just-mentioned end capped antistats.

Emulsifiers within the purview of the invention are end capped alkylene(lower) oxide, e.g., polyoxyethylene (POE), condensates of synthetic esters of branches or straight chain, saturated or unsaturated, aliphatic $C_3$–$C_{18}$ alcohols and branched or straight chain, saturated or unsaturated, aliphatic $C_8$–$C_{18}$ mono- or di-carboxylic acids; end capped alkylene oxide condensates of polyhydric aliphatic $C_6$–$C_{18}$, branched or straight chain, saturated or unsaturated, alcohols, or partial esters thereof with said aliphatic $C_8$–$C_{18}$ mono- or di-carboxylic acids, branched or straight chain, saturated or unsaturated; end capped alkylene oxide condensates of long chain, branched or straight chain, saturated or unsaturated, aliphatic $C_6$–$C_{18}$ monohydric alcohols; end capped alkylene oxide condensates of amides derived from alkanol (lower) amines and long chain saturated or unsaturated, branched or straight chain, aliphatic $C_8$–$C_{18}$ mono- or di-carboxylic acids; and end capped alkylene oxide condensates of alkyl ($C_6$–$C_{18}$) - substituted, hydroxy-terminated aryls, e.g., an alkyl phenol such as octyl- or dedocyl-substituted phenol. Preferably, the condensates contain up to about 50 moles of alkylene oxide, per mole of ester, alcohol or amide.

Illustrative emulsifiers suitable for end capping are the following condensates containing up to about 50 moles of alkylene oxide, such as ethylene oxide (EtO), per mole of ester, alcohol or amide:

POE(12) laurate
POE(30) stearyl amine
POE(12) tridecyl alcohol
POE(18) heptadecyl alcohol
POE(12) stearyl alcohol
POE(16) sorbitan monolaurate
POE(5) dodecyl phenol
POE(18) pentaerythritol monooleate
POE(12) ethanolamidooleate
POE(23) glycerol laurate
Monolaurate of polyethylene glycol (500MW)

Typical lubricants within the purview of the present invention, viz., refined white oil, mono- or diesters of aliphatic $C_8$–$C_{18}$, branched or straight chain, saturated or unsaturated, carboxylic acids with a monohydric aliphatic alcohol $C_3$–$C_{18}$, branched or straight chain, the esters generally having a viscosity of less than about 50 centipoises, generally between 15 and 40 centipoises, over the relative humidity range of 10 to 100 percent, measured at 35° C., include:

butyl stearate
isobutyl palmitate
octyl stearate
isopropyl myristate
isocetyl stearate
dioctyl sebacate
trimethylolpropane tripelargonate
pentaerythritol tetrapelargonate
mineral oil
coconut oil
corn oil
sperm oil According to a preferred embodiment of the present invention the emulsifiers are present in the finish composition in the concentration (based upon the total weight of the composition) of about 5 to about 25% by weight, preferably from about 8 to about 18, weight/weight (w/w); the lubricant is present in the concentration of about 30% to about 60% (w/w), preferably from about 37% to about 50%; when present the emulsifier-stabilizer component, viz., a salt of a dialkyl sulfosuccinic acid, is present in the concentration range of about 1 to about 20% (w/w), preferably from about 2.5 to about 10%.

According to the preferred embodiment, an antistat is generally present, usually in the range of about 5 to about 25% (w/w), preferably about 7.5 to about 20%. As hereinbefore mentioned, the antistat may be an end capped emulsifier of the type contemplated herein, in neutral salt form, or it may be anyone of a number of conventional antistats which, pursuant to the present invention, have been end capped, such as the neutral salts of end capped alkoxylated or non-alkoxylated esters of aliphatic ($C_6$–$C_{18}$) or aromatic alcohols (e.g., benzyl, nonylbenzyl, and the like) and phosphoric acid, and the neutral salts of end capped alkoxylated esters of aliphatic ($C_6$–$C_{18}$) or aromatic alcohols and sulfur trioxide. Obviously, when an end capped alkylene oxide condensate emulsifier is used as the antistat, the concentration of emulsifier may, so to speak, be increased proportionately, i.e., beyond 25% if desired. Of course, the discovery that the end capped alkylene oxide condensate emulsifiers of the present invention double as emulsifying-antistatic agents obviates any real need to add conventional antistats which have been end capped, even at emulsifier concentrations in the range of about 5 to about 25% (w/w), the higher concentrations in this range providing better antistatic properties.

Preferably, alkoxylation of the alcohol phosphate of sulfate ester salt antistatic agent is in the range of about 3 to about 5 moles of alkylene oxide (e.g., EtO) per mole of alcohol phosphate or sulfate ester salt. Typical alcohol-derivative moieties (ester groups) on the phosphate or sulfate ester salt are those derived from fatty alcohols $C_6$–$C_{18}$, such as stearyl, oleyl, lauryl alcohols, and the like, there being, generally, about one or two ester groups per mol of acid. Furthermore, while alkali metals, ammonia and aliphatic amines are suggested hereinbefore as neutralizing salts, other suitable salts are the alkanolamines, e.g., diethanolamine, triethanolamine, morpholine, and the like.

As aqueous emulsion of the aforementioned finish composition components may be prepared, for example, by admixing the lubricant, emulsifier and antistat and, if desired, a dialkyl sulfosuccinate and warming same to a temperature in the range of, say, about 30° to about 40° C. until a smooth, uniform blend is achieved. Sufficient of the resulting mixture or blend is poured slowly, with agitation, into hot water (at least about 55° C.) to make an emulsion of from about 2 to about 25% solids, by weight, preferably from about 5 to 20%, based upon the total weight of the finish components and the water.

Generally, the mixture is neutralized at this point by adding to the agitating blend an aqueous alkali metal hydroxide solution or an organic base, such as triethanolamine, diethanolamine, ethanolamine, morpholine, and the like. Typically, a 10 to 15% (w/w) aqueous solution of potassium hydroxide may be used to achieve a pH of, say, about 7.0–8.0(± 0.5). If desired, a small amount (e.g., about 0.25 to 2.0% w/w) of a buffer, such as potassium carbonate, is also added. If desired, a minor but effective amount [e.g., 300–800 parts per million (ppm)] of a bacteriastat may be added after homogenizing and cooling the oil/water emulsion. Also, a defoamer (e.g., about 1000 ppm) may be introduced into the emulsion, but generally prior to cooling. Aging of the emulsion for at least about 24 hours is advisable to allow the bacteriastat sufficient time to hydrolyze.

Typically, the fibers to be treated with the above aqueous emulsion finish, such as polyester and polyamide yarns, homo- or copolymers, are best passed, at a controlled rate, through a nock in one end of a capillary tube having the usual bore therethrough which bore, at one end thereof, opens into the base of the nock and, at the other end thereof, receives the aqueous emulsion, the finish being thus metered onto the yarn at a uniform rate. The emulsion-treated yarn is then preferably drawn while heating to evaporate water therefrom and provide a water-dried finish solids pickup by the yarn in the range of about 0.3 to about 1.0% (weight/weight).

Generally, the fibers or filaments to be treated are formed into a unified bundle before being treated, i.e., they are not in a dispersed state. For example, molten polymer streams (incipient filaments) issuing from a spinnerset are cooled by directing the streams vertically downward through a cooling zone, e.g., a quenching chimney, thus forming filaments which are then combined into bundles or yarns. The present invention contemplates applying a finish before or after the filaments are combined into a bundle or yarn. The filaments may be sprayed with a mist or fog of the novel aqueous emulsion herein described. Alternatively, the yarn may be wiped with the finish by the use of conventional finish rolls dipped into a pan containing the aqueous emulsion finish, the rolls generally being part of the take-up equipment and normally made of stainless steel, carborundum, glass or other like inert material. Slow speed rotation of the rolls usually transmits a small but effective amount of the finish to the filamentary substrate and the thus-treated filaments are subsequently collected in an orderly manner for further processing.

EXAMPLES

The present invention will best be understood from the Examples which follow, all of which are intended to be illustrative only and are not meant to unduly limit the scope of the invention (percentages are on a weight/weight basis unless otherwise indicated):

Example I

Freshly spun nylon 6:6 yarn having a denier of 70 and 34 filaments is treated, using a capillary tube as taught herein, with a 10% aqueous emulsion finish prepared as taught above and neutralized to a pH of about 7.4 using a 12% aqueous solution of KOH, the finish having the following composition:

| | Component | % |
|---|---|---|
| 1. | Butyl stearate | 30 |
| 2. | 2-Ethylhexyl stearate | 10 |
| 3. | Sodium tridecylacetate/6EtO, end capped with acetyl moieties using the sodium salt of chloroacetic acid | 15 |
| 4. | KOH neutralized alkyl ($C_{10}$) alcohol phosphate ester/4 EtO, end capped with $P_2O_5$ | 25 |
| 5. | Sodium di-(2-ethylhexyl)sulfosuccinate | 20 |

The nylon 6:6 yarn thus treated is then dried at a temperature of 110 C. while being drawn, the finish solid pickup thereon being 0.5% solids (w/w).

This yarn when processed exhibits reduced filament flaring, minimized attack on the polyurethane parts of texturing equipment, good fiber/metal lubrication behavior, good drawing processing characteristics, minimized deposition, and exceptionally good performance in false twist processing, resulting in high tension ratios, low creel tensions. Of course, the other characteristics important to realize good finish properties are present.

Example II

Example I is repeated in every essential respect with the exception that the freshly spun polymer is a polyester polyethylene terephthalate) yarn having a denier of 150 and 36 filaments and the aqueous emulsion finish used to treat the yarn has a concentration of 25% (w/w).

Results comparable to those for the product of Example I are experienced.

Example III

Example I is repeated in every essential respect with the exception that the finish has the following composition:

| | Component | % |
|---|---|---|
| 1. | Mineral oil | 20 |
| 2. | Butyl stearate | 30 |
| 3. | POE(40) sorbitol hexaoleate | 30 |
| 4. | POE(6) $C_{10}$ phosphate, KOH neutralized | 20 |

Again, comparable and desirable results are achieved.

Example IV

Example II is repeated in every essential respect with the exception that the aqueous emulsion finish used to treat the yarn has the following composition:

| | Component | % |
|---|---|---|
| 1. | Butyl stearate | 30 |
| 2. | Hexadecyl stearate | 20 |
| 3. | POE(10) $C_{14}$ alcohol sulfate, KOH neutralized | 25 |
| 4. | POE(6) $C_{10}$ phosphate, KOH neutralized | 25 |

Comparable and desirable results are achieved.

Example V

Example I is repeated in every essential respect with the exception that the aqueous emulsion finish used to treat the yarn has the following composition:

| | Component | % |
|---|---|---|
| 1. | Butyl stearate | 20 |
| 2. | Mineral oil | 30 |
| 3. | POE(3) $C_{12}$ — $OCH_3$ | 15 |
| 4. | POE(12) $C_{12}$ — $OCH_3$ | 15 |
| 5. | $C_{12}$ amide | 20 |

Comparable and desirable results are achieved.

Pursuant to statutory requirements, there are described above the invention and what are now considered its best embodiments. It should be understood, however, that the invention can be practiced otherwise than as specifically described, within the scope of the appended claims.

What is claimed is:

1. A synthetic fiber finish composition consisting essentially of: (1) an emulsifier comprising an alkylene (lower) oxide condensate of a synthetic ester of a branched or straight chain, saturated or unsaturated, aliphatic $C_3$–$C_{18}$ alcohol and a branched or straight chain, saturated or unsaturated, aliphatic $C_8$–$C_{18}$ mono- or di-carboxylic acid; an alkylene oxide condensate of a polyhydric aliphatic $C_6$–$C_{18}$, branched or straight chain, saturated or unsaturated, alcohol, or partial ester thereof with said aliphatic $C_8$–$C_{18}$ mono- or di-carboxylic acid, branched or straight chain, saturated or unsaturated; an alkylene oxide condensate of a long chain, branched or straight chain, saturated or unsaturated, aliphatic $C_6$–$C_{18}$ monohydric alcohol; an alkylene oxide condensate of an amide derived from an alkanol (lower) amine and a long chain saturated or unsaturated, branched or straight chain, aliphatic $C_8$–$C_{18}$ mono- or di-carboxylic acid; or an alkylene oxide condensate of an alkyl ($C_6$–$C_{18}$)-substituted, hydroxy-terminated aryl; or a mixture of these; (2) a lubricant comprising a mono- or diester of an aliphatic $C_8$–$C_{18}$, branched or straight chain, saturated or unsaturated, carboxylic acid with a monohydric aliphatic alcohol $C_3$–$C_{18}$, branched or straight chain, or a refined mineral, animal or vegetable oil; said emulsifiers containing up to about 50 moles of alkylene oxide per mole of ester, alcohol, or amide and the reactive hydroxyl sites of said emulsifiers containing deactivating end cap groups selected from the group consisting of methyl, acetyl, sulfate, the residue of a fatty acid ($C_8$–$C_{18}$), phosphate, and mixtures thereof and (3) as an emulsifier-stabilizer component, a small but effective amount of an alkali salt of a dialkyl sulfosuccinic acid.

2. The composition of claim 1 wherein a likewise end capped antistat is also present, the antistat comprising a neutral alkali salt of an alkoxylated(lower alkyl) or non-alkoxylated ester of phosphoric acid or sulfur trioxide and an aliphatic ($C_6$–$C_{18}$) alcohol, branched or straight chain, saturated or unsaturated, or an aromatic alcohol.

3. The composition of claim 2 wherein the emulsifier component is present in the concentration of about 5 to about 25% by weight; the lubricant component is present in the concentration of about 30 to about 60% by weight; the emulsifier-stabilizer component is present in the concentration of about 1 to about 10% by weight; and the antistat component is present in the concentration of about 5 to about 25% by weight, all of the above weight percentages being based upon the total weight of the composition.

4. The composition of claim 3 wherein the antistat component is the neutral salt form of the end capped emulsifier component.

5. The composition of claim 3 wherein the emulsifier condensate contains up to about 50 mols of alkylene oxide, per mol of ester, alcohol or amide.

6. The composition of claim 5 wherein the alkylene oxide moiety is ethylene oxide.

7. The composition of claim 1 wherein the lubricant has a viscosity of 50 centipoises over the relative humidity range of 10 to 100 percent, measured at 35° C.

8. The composition of claim 2 wherein the emulsifier component is present in the concentration of about 8 to about 18% by weight; the lubricant component is present in the concentration of about 37 to about 50% by weight; the emulsifier-stabilizer component is present in the concentration of about 2.5 to about 6% by weight; and the antistat component is present in the concentration of about 7.5 to about 20% by weight, all of the above weight percentages being based upon the total weight of the composition.

9. The composition of claim 2 wherein the antistat contains from about 3 to about 5 mol alkylene oxide per mol of alcohol acid ester salt.

10. The composition of claim 9 wherein the alkylene oxide is ethylene oxide.

11. An aqueous emulsion containing from about 2 to about 25% by weight of the composition of claim 1.

12. An aqueous emulsion containing from about 2 to about 25% by weight of the composition of claim 3.

* * * * *